US008618906B2

(12) United States Patent
Al-Jafar

(10) Patent No.: US 8,618,906 B2
(45) Date of Patent: Dec. 31, 2013

(54) REMOTE CONTROL PARKING BARRIER

(76) Inventor: Ahmed I.S.I. Al-Jafar, Alqurane (KW)

( * ) Notice: Subject to any disclaimer, the term of this patent is extended or adjusted under 35 U.S.C. 154(b) by 370 days.

(21) Appl. No.: 12/858,466

(22) Filed: Aug. 18, 2010

(65) Prior Publication Data

US 2012/0044046 A1 Feb. 23, 2012

(51) Int. Cl.

| | |
|---|---|
| ***G05B 19/00*** | (2006.01) |
| ***B60Q 1/48*** | (2006.01) |
| ***B60Q 1/00*** | (2006.01) |

(52) U.S. Cl.
USPC ..... 340/5.2; 340/932.2; 340/435

(58) Field of Classification Search
USPC ..... 340/5.2, 932.2, 933, 435, 463, 5.71
See application file for complete search history.

(56) References Cited

U.S. PATENT DOCUMENTS

| | | | | |
|---|---|---|---|---|
| 4,137,662 | A * | 2/1979 | Baumer | 40/612 |
| 4,713,910 | A | 12/1987 | Quante | |
| 4,901,071 | A | 2/1990 | Fletcher | |
| 4,934,097 | A * | 6/1990 | Quante | 49/49 |
| 4,941,284 | A | 7/1990 | Stoller | |
| 5,438,799 | A | 8/1995 | Le Faucheur | |
| 5,711,110 | A | 1/1998 | Williams | |
| 6,150,958 | A * | 11/2000 | Worsham | 340/932.2 |
| 7,263,803 | B2 * | 9/2007 | Herwich et al. | 49/49 |
| 7,509,991 | B2 * | 3/2009 | Weik et al. | 160/188 |
| 2002/0043025 | A1 * | 4/2002 | Zayas | 49/33 |
| 2002/0162276 | A1 * | 11/2002 | Biton | 49/49 |
| 2007/0085067 | A1 * | 4/2007 | Lewis | 256/73 |

* cited by examiner

*Primary Examiner* — George Bugg
*Assistant Examiner* — Munear Akki
(74) *Attorney, Agent, or Firm* — Richard C. Litman

(57) ABSTRACT

A remotely controlled parking space barrier for preventing access to a reserved parking space by unauthorized vehicles includes a barrier assembly. The assembly includes an anchoring member and a rotatable barrier member that is rotatable between a relatively flat position that can be driven over and a vertical or blocking position for preventing vehicular access to the space. The remotely controlled parking space also includes a plurality of studs for anchoring the anchoring member within the parking space. The mechanism also includes an electric motor for rotating the barrier member between a generally flat and a generally vertical position. A lighting system includes a plurality of lights, an alarm and a first sensor for sensing an unauthorized vehicle within a predetermined distance from the entrance to the parking space and actuates flashing lights and sounds an audible alarm when an unauthorized vehicle approaches the entrance to the parking space or parks in front of the parking space. Further a transceiver is also provided and disposed in an authorized vehicle or carried by an authorized individual to send a signal to the transceiver to rotate the barrier member to a generally horizontal position to give access to the authorized vehicle to enter the space. Further, the barrier assembly includes a mechanism and a sensor for detecting a vehicle within the parking space and prevents the moveable barrier from being raised while the authorized vehicle is there and automatically raises the barrier upon removal of the authorized vehicle from the parking space.

10 Claims, 2 Drawing Sheets

REMOTE CONTROL PARKING BARRIER

FIELD OF THE INVENTION

This invention relates to a remote controlled parking space barrier for preventing unauthorized vehicles from using reserved spaces while allowing an authorized vehicle to park in the reserved space.

BACKGROUND OF THE INVENTION

Barrier posts for parking lots and passage ways are well known and have been in widespread public use for many years. For example, Quante U.S. Pat. No. 4,713,910 discloses a barrier for temporarily blocking access to parking places, driveways and access roads. As disclosed, a post is used, which is anchored in the ground and is foldable about an articulation arranged over the ground so that mechanism is activated over a receiver in cooperation with a portable emitter. The post is suitably built as a hollow body, so that the drive and the remaining parts can be safely lodged therein. In this manner, the barrier post can be remote controlled without difficulty from an approaching vehicle by means of the portable emitter.

A more recent Williams U.S. Pat. No. 5,711,110 discloses a vehicle parking barrier for temporarily blocking a reserved space. The barrier is installed on the surface and has a base with legs embedded within the surface. A hinge plate is attached to the base and allows the barrier to be rotated to a horizontal position permitting a vehicle to safely pass over the collapsed barrier. A channel shaped post is pivotally attached to the hinge plate and a rigid strut is retained on one end within the post and on the other to the hinge plate. The strut forms a right angle triangle with the post. In addition, a pull pin holds the upper end of the strut in place and when removed, permits the barrier to be rotated horizontally removing the obstruction. A second, or electromechanical, embodiment utilizes a linear actuator for the strut. An electronic controller receives a signal through a coded radio frequency transmitter and receiver and in turn energizes the actuator to rotate the barrier into a horizontal position. Limit switches control positioning and indicator lights and denote the barrier position. The electrical system operates on low voltage direct current supplied by a D.C. power supply.

Finally, Worsham U.S. Pat. No. 6,150,958 discloses a remote controlled parking barrier apparatus. As disclosed a radio-operated parking barrier apparatus is provided with a base housing, a barrier arm including a shaft rotatably mounted in the housing, and a drive assembly disposed within the base housing that includes a pivot arm having a proximal end affixed to the shaft, and a driver having a reciprocally driven plunger movably connected to the distal end of the pivot arm. The back end of the driver is pivotally connected to the floor panel of the base housing to accommodate the vertical movement of the accurate motion that the end of the plunger must necessarily follow in converting the linear movement of the plunger into the rotation movement of the barrier arm around the shaft mounted in the base housing. The driver preferably utilizes a threaded shaft and drive nut to reciprocate the driver in operating the device. The drive, assembly provides a simple and reliable linkage between the barrier arm and the base housing.

Notwithstanding the above it is presently believed that there is a need and a potential commercial market for an improved remote controlled barrier for a parking spaces or the like. There should be a demand and a potential market for such barriers because they are relatively compact, easy to install and waterproof so they can be installed in open parking lots. In addition, the system in accordance with the present invention senses unauthorized vehicles in the vicinity of the space and prevents unauthorized users from blocking or entering the space. Further, the systems in accordance with the present invention include a sensor that senses the removal of a vehicle from a reserved space and automatically raises the barrier within a pre-selected time of any such movement. The device can also be further modified to include a relatively bright flashing light and audible sound during daylight hours and a soft-flashing light and lesser sound during hours of darkness.

BRIEF SUMMARY OF THE INVENTION

A remotely controlled parking space barrier for preventing access to a reserved parking space by an unauthorized vehicle while allowing authorized vehicles to use the space includes a barrier assembly including an anchoring member and a rotatable barrier member that is rotateable between a relatively flat or horizontal position in a generally vertical position for preventing vehicular access to a reserved parking space. The assembly also includes means for anchoring the anchoring member in a parking space and includes a D.C. motor for rotating the barrier member between the generally flat or horizontal position that is generally parallel to the parking space and an upright or vertical position that prevents a vehicle from entering the space. In addition, a lighting system including a plurality of lights, an alarm and a first sensor for sensing an unauthorized vehicle within a predetermined distance from the parking space and means for flashing the lights in the lighting system and sounding the alarm when an unauthorized vehicle approaches the reserved space or comes within a predetermined distance of the entrance to the reserved space. Additional means are disposed within an authorized vehicle or on an authorized individual to send a signal to a receiver to rotate the barrier member to a generally horizontal position to thereby allow access to the authorized vehicle.

A preferred embodiment of the invention also includes means for detecting a vehicle within the parking space and upon departure thereof automatically actuating the rotatable barrier member into a generally vertical position.

The invention will now be described in connection with the accompanying figures wherein like reference numerals have been used to indicate like parts.

DESCRIPTION OF THE PREFERRED EMBODIMENTS OF THE INVENTION

Figure 1:
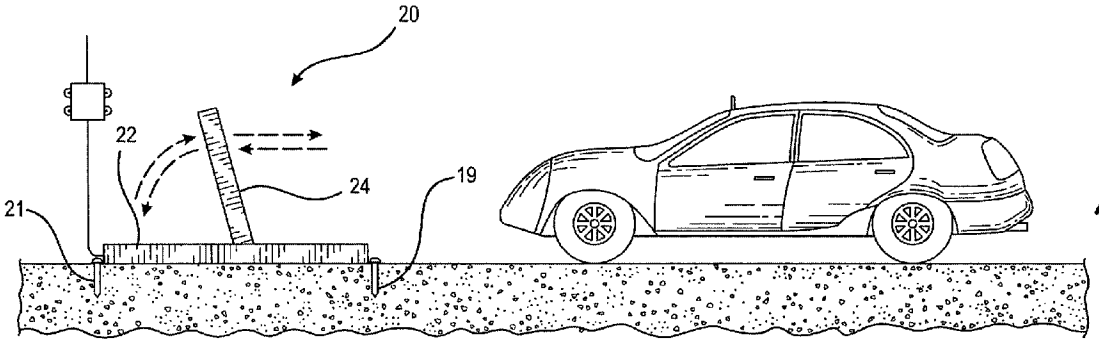
FIG. 1 is a side elevational view of a barrier in accordance with the present invention.

As illustrated in FIG. 1 a barrier assembly 20 in accordance with a preferred embodiment of the invention comprises a generally flat box shaped waterproof metal container that includes an anchoring member 22 and a barrier member 24 rotatably attached to the anchoring member 22. The assembly 20 is fixed within a parking space by four studs 19, 21, 23, and 24. The basic design is based on a unit that can be placed in an open black top parking area with parking spaces marked by white lines and four studs of significant size and length to discourage thieves form attempting to remove the barrier. If a greater deterrent to thieves is of interest, it is contemplated that the assembly 20 may be set in concrete.

Figure 4:
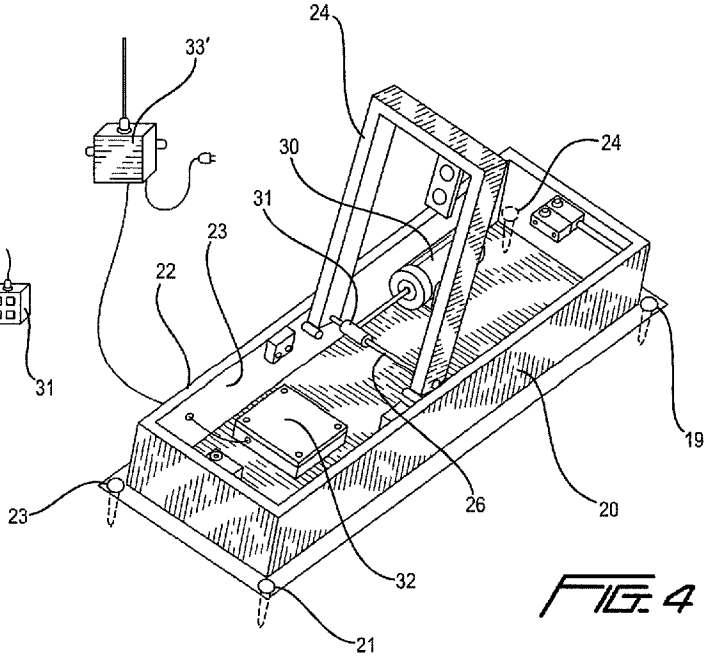
FIG. 4 is a perspective view of a barrier showing the mechanism for lowering the barrier.
Figure 3:
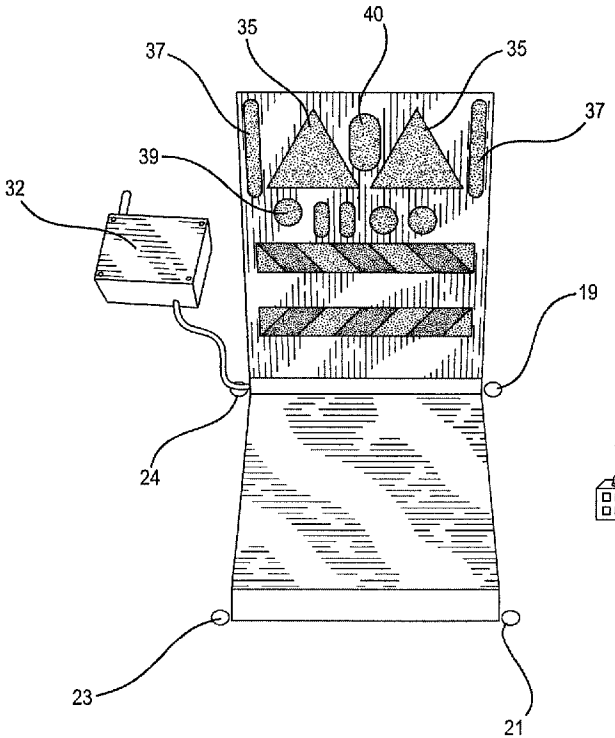
FIG. 3 is a perspective view of a remote controlled parking barrier in accordance with a preferred embodiment of the invention wherein the barrier has been rotated into a position that prevents a vehicle from entering the space.

Referring more specifically to FIGS. 1, 3 and 4 the barrier member 24 is rotatable mounted on a shaft 26 (FIG. 4) that extends between a pair of side members 28. An electric motor or pneumatic pump 30, preferably a D.C. motor that is powered by a battery (not shown) rotates the barrier member 24 by means of a drive mechanism 31 is shown schematically in FIG. 4. A solar panel (not shown) can be used to recharge the battery and is positioned to receive the sun's rays whether or not a car is parked over the assembly 20.

The barrier assembly 24 is preferably operable by a remote controlled apparatus 32 and 32' shown schematically in FIGS. 1 and 4 in response to a signal from a unit 31 disposed in an authorized vehicle or carried by an authorized individual. The electrical device is similar to the conventional garage door openers that are in common use.

When an operator of an authorized motor vehicle approaches their reserved space, they press a button on the vehicle disposed device to send a signal to activate the barrier to thereby rotate the barrier member 24 to its relatively flat position. The driver then pulls the vehicle into the reserved space over the assembly 20.

Figure 2:
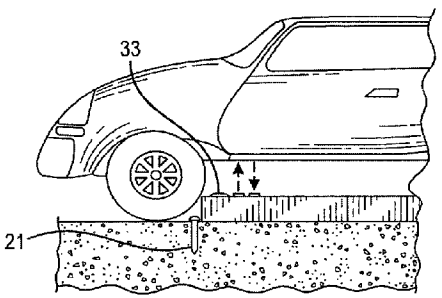
FIG. 2 is a side elevational view of a barrier in accordance with the present invention with an authorized vehicle parked over top of the barrier.

As illustrated in FIG. 2, a sensor 33 such as an ultrasonic wave generator disposed in the barrier 24 sends an ultrasonic wave upwardly where it is reflected from the bottom of the vehicle and received by a sensor in the barrier member 24 to automatically disable the circuitry that would activate the motor 30 to thereby prevent the movement of the barrier member 24.

FIG. 3 illustrates the barrier member 24 in its upright or barrier position with two triangular reflectors 35 each of which includes a plurality of lights 34 as for example one light at each of the three corners of the triangle. The barrier member also includes two strips 36 of reflective tape and two arrays of light emitting diodes 37. A bulb 38 or strobe light is also provided for warning an unauthorized vehicle that attempts to enter the reserved space or attempts to block the entrance of a reserved space to move their vehicle. It is believed that a loud alarm and bright strobe light will discourage drivers who attempt to block the reserved space. For individuals who may ignore subtle reminders to move, failure to heed the warning may result in an automatic telephone to a tow away service.

As illustrated in FIG. 3, the barrier member 24 may also include a photo cell 39 which modifies the strobe light to provide a more intense light during daylight hours and less intense during hours of darkness. The barrier member 24 also includes an ultrasonic transmitter/receiver/sensor 40.

A further embodiment of the invention provides multiple levels of reserved spaces. For example, it is contemplated that an individual can rent an individual reserved space that is reserved exclusively for his/her use. However, it is also contemplated that an individual can also for a lesser price reserve access for one vehicle to use up to four, five, six spaces or more. In such cases a multi-channel RF Transceiver is used and the number of RF channels will be equal to the number of adjacent assigned spaces. In such cases, the same channels can be used in other parking areas within a city or region since the coverage of the transceiver is limited to several meters. In this way an individual can reserve limited access to a number of preferred spaces across the city for their personal use when visiting doctors, lawyers, stores, restaurants and the like.

While the invention has been described in connection with its preferred embodiments it should be recognized that changes and modifications may be made therein without departing from the scope of the appended claims.

What is claimed is:

1. A remotely controlled parking space barrier for preventing access to a reserved space by an unauthorized vehicle, said barrier comprising:

a barrier assembly including an anchoring member and a rotatable barrier member rotatable between a relatively horizontal or flat position that permits a vehicle to park over the member and a generally vertical position for preventing vehicular access to a space, wherein the rotatable barrier member includes two arrays of light emitting diodes and a strobe light that operate when the barrier is in a closed position and an unauthorized vehicle is in front of said space;

means for anchoring said anchoring member in a parking space and means including a motor for rotating said barrier between a flat accessible position and a generally vertical barrier position;

a lighting system including a plurality of lights, an alarm and a first sensor for sensing an unauthorized vehicle within a predetermined distance from the parking space and means for flashing said lights in said lighting system and sounding said alarm when an unauthorized vehicle approaches the reserved space or comes within a predetermined distance of an entrance to the reserved space;

means disposed within an authorized vehicle or on an authorized individual to send a signal to a receiver to rotate the barrier to a generally horizontal position to give access to the authorized vehicle or to a vehicle driven by an authorized individual; and means including said sensor for detecting a vehicle within the parking space and upon departure thereof automatically actuating said rotatable barrier member into a generally vertical position.

2. A remotely controlled parking space barrier for preventing access to a reserved space by an unauthorized vehicle according to claim 1 wherein said anchoring means includes four studs for anchoring said anchoring member with a parking space.

3. A remotely controlled parking space barrier for preventing access to a reserved space by an unauthorized vehicle according to claim 1 in which said barrier assembly is waterproof.

4. A remotely controlled parking space barrier for preventing access to a reserved space by an unauthorized vehicle according to claim 1 which includes two triangular reflectors on said rotatable barrier member.

5. A remotely controlled parking space barrier for preventing access to a reserved space by an unauthorized vehicle according to claim 1 in which an ultrasonic transmitter/receiver sensor is fixed to said rotatable barrier member.

6. A remotely controlled parking space barrier for preventing access to a reserved space by an unauthorized vehicle according to claim 1 which includes means for sensing an unauthorized vehicle in front of a reserved space and means for flashing said lights and sounding said alarm when an unauthorized vehicle blocks an entrance to the reserved space.

7. A remotely controlled parking space barrier for preventing access to a reserved space by an unauthorized vehicle according to claim 1 which includes a sensor for sensing a vehicle parked over said barrier and preventing the barrier from rotating upwardly until after the parked vehicle is moved out of the space.

8. A remotely controlled parking space barrier for preventing access to a reserved space by an unauthorized vehicle according to claim 1 which includes a sensor and variable timer so that if an individual removes an unauthorized vehicle from the reserved space without using a signal to raise the barrier within a predetermined time, automatically raises the barrier.

9. A remotely controlled parking space barrier for preventing access to a reserved space by an unauthorized vehicle according to claim 1 in which said strobe light flash brightly during daylight and softly in the dark.

10. A remotely controlled parking space barrier for preventing access to a reserved space by an unauthorized vehicle according to claim 1 which includes a radio frequency identifier wireless control transceiver.

* * * * *